US005123580A

United States Patent [19]

Lee

[11] Patent Number: 5,123,580

[45] Date of Patent: Jun. 23, 1992

[54] KEY HOLDER

[76] Inventor: Jong W. Lee, 722 S. Western Ave., Los Angeles, Calif. 90005

[21] Appl. No.: 469,161

[22] Filed: Jan. 24, 1990

[51] Int. Cl.[5] ..... A45F 5/00

[52] U.S. Cl. ..... 224/253; 70/456 B

[58] Field of Search ..... 224/253, 252; 70/456 B, 70/456 R

[56] References Cited

U.S. PATENT DOCUMENTS

| | | | |
|---|---|---|---|
| 1,618,573 | 2/1927 | Cole | 224/252 |
| 2,349,107 | 5/1944 | Murtaugh | 224/253 |
| 2,442,621 | 6/1948 | Silverstein | 224/253 |
| 2,783,926 | 3/1957 | Wise | 224/252 |
| 3,129,862 | 4/1964 | Cone | 224/253 |
| 3,777,954 | 12/1973 | Theodore | 224/253 |

*Primary Examiner*—Linda J. Sholl

[57] ABSTRACT

The present invention provides an improved key holder. In one embodied form, the unique key holder comprises of a body capable of holding a multitude of keys and a novel strap member that is attached to said body which enables the key holder to be comfortably worn on the belt of the carrier. The unique design of the strap member permits the key holder to be put on and off the belt easily without unbuckling the belt.

2 Claims, 1 Drawing Sheet

KEY HOLDER

BACKGROUND OF THE INVENTION

1. Field of the Invention

The subject invention relates to key holders or cases. In one embodied form, the disclosed invention comprises of a body capable of carrying a number of keys and a strap member which enables the key holder to be comfortably worn o the belt of the carrier.

2. Description of the Prior Art

Over the years, many attempts have been made to improve the means by which a multitude of keys can be carried in a comfortable and attractive fashion. A brief search of the existing patents reveal that most of these attempts fall into a few categories.

First, there have been attempts to improve the means by which the keys are secured to the body of the key holders such as in U.S. Pat. Nos. 1,646,485, Des 118,440, 2,648,215, 2,699,192, and 3,379,041. Second, numerous attempts have been made to combine the key holder with some functions of a wallet or a purse by adding special compartments for holding things like coins, bills, documents, etc. to the key holder as in U.S. Pat. Nos. 1,752,380, 1,758,297, 2,203,830, 2,270,015, Des 127,283 and Des 147,225. The third category belongs to improved key rings that are designed to be worn on the belt as in U.S. Pat. Nos. 3,929,266 and 3,968,670.

The patents belonging to the first and second categories are concerned with how to better secure the keys to the key holder or how to add more compartments to the key holder so that things other than keys can be carried in the key holder. One of the major disadvantages of these key holders is that they are designed to be carried in the pocket(for males at least). Carrying the key holder in ones pocket is both unattractive and uncomfortable due to the substantial bulge created on the thighs by the bulk of the key holder.

The patents belonging to the third group are concerned with the coupling mechanism between the key ring member and the part that is secured to the belt of the carrier. There are two significant drawbacks to wearing key rings. First, it is considered unattractive and certainly not suitable for formal attire occasions by many people. Second, because the keys are not tightly wrapped together nor tightly secured to the wearer, it makes substantial amount of noise and discomfort slapping against each other and against the wearer.

SUMMARY OF THE INVENTION

The improved key holder in its presently preferred embodiment has significant advantages over the prior art. It enables the key holder to be comfortably worn on the belt of the carrier thereby eliminating the unsightly bulging pants pocket. Furthermore, the improved key holder has an elegant appearance unlike the "janitorial" appearance of key rings. It also firmly hugs the belt of the carrier, unlike the free-swinging key rings, which eliminates the annoying tapping of the body by the suspended key ring.

The improved key holder in its presently preferred form consists of a body capable of holding a number of keys, much like a conventional leather key holder, and a strap member which is designed to firmly secure the key holder to the belt or other appropriate article or clothing of the carrier. The said strap member is, in its presently preferred form, attached to the upper part of the back side of the body of the key holder and extends down and up to the front side of the body of the key holder and secures to the upper flap of the key holder by a securing mean such as clasps or Velcro fasteners.

The improved key holder in its presently preferred form can not only be worn on the belt but it can, if the carrier chooses to, be carried in the pocket or pulse like a conventional key holder. This is possible because the strap member of the improved key holder does not introduce significant additional bulk to the key holder.

DETAILED DESCRIPTION OF THE PREFERRED EMBODIMENT

This invention provides an improved key holder which can be worn on the belt or be carried like a conventional key holder.

Figure 1:
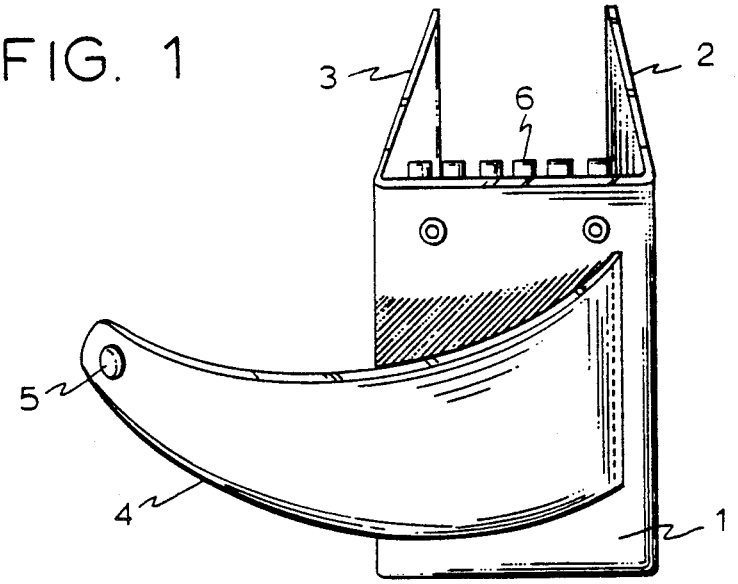
FIG. 1 is a rear perspective view of the improved key holder in its presently preferred form.

Referring to FIG. 1, the improved key holder consists of a back portion 1, a front upper flap 2, a front lower flap 3, a strap member 4, and a key loop retainer piece 6. Said strap member 4 is securely attached to the upper part of the said back portion 1.

Figure 2:
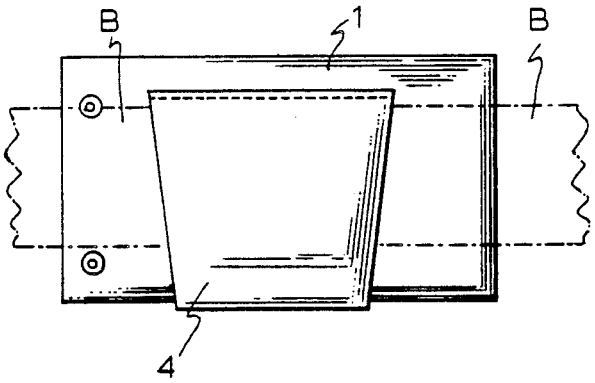
FIG. 2 is a rear view of the improved key holder in its presently preferred form.
Figure 3:
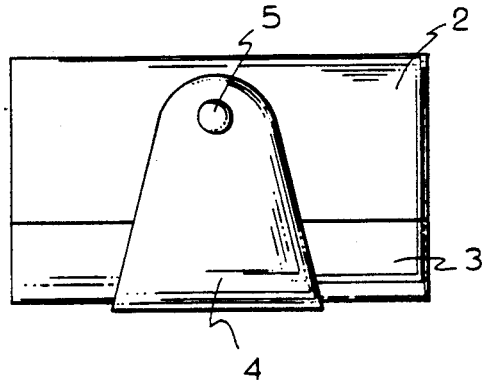
FIG. 3 is a front view of the improved key holder in its presently preferred form.

Referring to FIG. 2, belt B is shown wedged between the back portion 1 and the strap member 4. When wearing the improved key holder on the belt, the end of the strap member 4 is inserted downward behind the belt B and then brought upward and to the front and secured to the front upper flap 2 by a clasp button 5 (please refer to FIG. 3).

Figure 4:
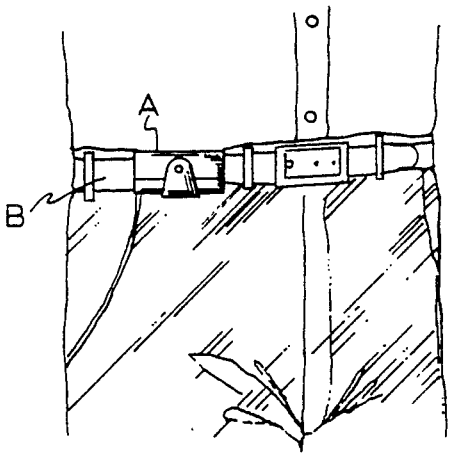
FIG. 4 is a view of the improved key holder in its presently preferred form on a person's belt.

Referring to FIG. 4, the improved key holder A is shown secured to the belt B of a carrier.

I claim:

1. A key holder for removable attachment to an apparel belt, comprising in combination:

(a) a foldable base member having an outer-surface, and an inner-surface secured thereto, said base member comprising a front upper portion, a back portion, and a front lower portion; said front upper and front lower portions being adaptable to overlap one another to surmount said back portion and form a folded position; said base member having mounted thereon, means for retaining at least one key;

(b) an elongated attachment strap having an outer-surface and an inner-surface disposed on the outer surface of said base member, said strap having a distal end, a mid-section and a proximate end; said proximate end of said strap being secured to the outer surface of said back portion of said foldable base member, and said mid-section of said attachment strap being of sufficient length to surmount the overlapped front upper and front lower portions of said base member when folded thereby to provide a slot for receiving an apparel belt between the outer-surface of said back portion of said base member and said inner-surface of said elongate attachment strap; and (c) a detachable fastening means to secure said distal end of said attachment strap to an outer surface of one front portion of said foldable base member when said at least one key is maintained within said folded position.

2. The key holder as defined in claim 1 wherein said fastening means is a clasp button.

* * * * *